US010980315B2

(12) United States Patent
Yoshikawa et al.

(10) Patent No.: US 10,980,315 B2
(45) Date of Patent: Apr. 20, 2021

(54) SHOE SOLE STRUCTURE AND SHOE USING SAME

(71) Applicant: Mizuno Corporation, Osaka (JP)

(72) Inventors: Naoki Yoshikawa, Osaka (JP); Takashi Nakamura, Osaka (JP)

(73) Assignee: Mizuno Corporation, Osaka (JP)

( * ) Notice: Subject to any disclaimer, the term of this patent is extended or adjusted under 35 U.S.C. 154(b) by 366 days.

(21) Appl. No.: 16/087,857

(22) PCT Filed: Feb. 23, 2017

(86) PCT No.: PCT/JP2017/006757
§ 371 (c)(1),
(2) Date: Sep. 24, 2018

(87) PCT Pub. No.: WO2017/163741
PCT Pub. Date: Sep. 28, 2017

(65) Prior Publication Data

US 2019/0110553 A1 Apr. 18, 2019

(30) Foreign Application Priority Data

Mar. 25, 2016 (JP) ..... JP2016-062769

(51) Int. Cl.

| | |
|---|---|
| ***A43B 13/22*** | (2006.01) |
| ***A43B 13/18*** | (2006.01) |
| ***A43B 13/12*** | (2006.01) |
| ***A43B 5/00*** | (2006.01) |

(52) U.S. Cl.
CPC ..... *A43B 13/223* (2013.01); *A43B 5/00* (2013.01); *A43B 13/12* (2013.01); *A43B 13/18* (2013.01); *A43B 13/22* (2013.01)

(58) Field of Classification Search
CPC ..... A43B 13/223; A43B 13/12; A43B 13/18; A43B 13/22; A43B 13/023; A43B 13/122; A43B 13/14; A43B 13/16; A43B 13/181; A43B 13/184; A43B 13/24; A43B 13/26;
(Continued)

(56) References Cited

U.S. PATENT DOCUMENTS 5,170,572 A * 12/1992 Kantro ..... A43B 7/1425 36/173
5,367,791 A 11/1994 Gross et al.
2002/0184793 A1 12/2002 Sato
(Continued)

FOREIGN PATENT DOCUMENTS

JP 200352404 A 2/2003
JP 2004242692 A 9/2004
(Continued)

OTHER PUBLICATIONS

International Search Report and Written Opinion issued in counterpart International Application No. PCT/JP2017/006757 dated Mar. 28, 2017.

*Primary Examiner* — Jameson D Collier
(74) *Attorney, Agent, or Firm* — Troutman Pepper Hamilton Sanders LLP; James E. Schutz; Micah B. Hensley

(57) ABSTRACT

In a sole structure, a first projection can be deformed more easily toward a heel than tiptoe in a through hole of a sole component, due to a heel side gap which is formed between an inclined surface of the first projection and a wall of the first through hole located closer to the heel.

12 Claims, 6 Drawing Sheets

(58) Field of Classification Search
CPC ..... A43B 5/00; A43C 15/16; A43C 15/161; A43C 15/162; A43C 15/168
See application file for complete search history.

(56) References Cited

U.S. PATENT DOCUMENTS

| | | | | |
|---|---|---|---|---|
| 2003/0061733 | A1* | 4/2003 | Karsten | A43B 21/26 36/43 |
| 2005/0166425 | A1* | 8/2005 | Seiter | A43B 7/22 36/44 |
| 2008/0209763 | A1* | 9/2008 | Litchfield | A43B 13/203 36/29 |
| 2009/0019729 | A1* | 1/2009 | Nakano | A43B 7/14 36/91 |

FOREIGN PATENT DOCUMENTS

| | | | |
|---|---|---|---|
| JP | 2009233163 | A | 10/2009 |
| JP | 2017/006757 | A | 4/2011 |

* cited by examiner

SHOE SOLE STRUCTURE AND SHOE USING SAME

This application is a U.S. National Stage of International Patent Application No. PCT/JP2017/006757, filed 23 Feb. 2017, which claims the benefit of Japanese Application No. JP2016-062769, filed 25 Mar. 2016. The entire contents of which are hereby incorporated in their entireties by reference herein.

BACKGROUND

The present invention relates to a shoe sole structure and a shoe including such a sole structure.

BACKGROUND ART

Shoes for indoor sports such as volleyball, handball, and basketball have been known. For example, Patent Document 1 discloses shoes for this purpose.

Specifically, Patent Document 1 discloses a sole assembly for a sport shoe. The sole assembly includes three layers, namely, an upper layer, an intermediate layer, and a lower layer. The upper and lower layers are each made of a soft elastic member, and the intermediate layer sandwiched between the upper and lower layers is made of a sheet of synthetic rubber or synthetic resin having a higher hardness than the upper and lower layers. This sheet has a plurality of projections projecting toward a ground surface, while the lower layer has a plurality of through holes extending in the vertical direction. Each of the projections is fitted in an associated one of the through holes. The projection has a truncated cone shape gradually decreasing in diameter toward the distal end, and a gap is formed between the outer peripheral surface of each projection and the associated through hole.

CITATION LIST

Patent Documents

Patent Document 1: Japanese Unexamined Patent Publication No. 2003-52404

SUMMARY OF THE INVENTION

Technical Problem

In recent years, athletes' playing styles show a tendency toward being quicker. In view of this tendency, sport shoes for use in indoor sports such as volleyball, handball, basketball, etc. are required to enable a user to smoothly shift his/her weight, using the heel of his/her foot as a supporting point, while maintaining the cushioning properties and stability especially for the heel of the foot. More specifically, there has been an increasing need for shoes that allow a user wearing the shoes to swiftly make a next movement such as a dash in a forward direction, quick stop of a rearward movement, and a turn to the left (right), during exercise, using the heel of his/her foot as a supporting point.

However, in the shoe of Patent Document 1, an annular gap is formed between the entire outer peripheral surface of each projection and the associated through hole, so that each projection is easily deformed in all directions in the associated through hole. For this reason, when a user wearing the shoes of Patent Document 1 intends to quickly stop his/her rearward movement, for example, each projection receives a reaction force from a floor surface at the time of contacting with the floor surface, and is elastically deformed toward the tiptoe (toward the front) in the through hole, causing an excessive grip force. Consequently, there is a time lag between the moment at which the user feels himself/herself stopping his/her movement and the timing at which the quick stop is actually made. This may make it difficult for the user to swiftly make the next movement. That is, it is sometimes difficult for the shoes of Patent Document 1 to allow the user to smoothly shift the user's weight in accordance with the user's movement in the forward-backward direction.

In view of the foregoing background, it is therefore an object of the present invention to provide an improved shoe sole structure that enables a user to smoothly shift his/her weight, using the heel of his/her foot as a supporting point, in accordance with the user's movement in the forward-backward direction, while maintaining cushioning properties and stability for the user's heel.

Solution to the Problem

To achieve the above object, a first aspect of the present invention is directed to a shoe sole structure. The shoe sole structure includes: a sole component configured to support a heel of a human foot, and having at least one first through hole vertically passing through a lateral side portion of the sole component; and a projection member provided above the sole component, and including a base, and at least one first projection projecting from a lower surface of the base and inserted in the at least one first through hole of the sole component. A heel side gap is formed between a wall of the at least one first through hole located closer to a heel and a rear portion of the at least one first projection inserted in the at least one first through hole, and due to the heel side gap, the at least one first projection is deformed more easily toward the heel than tiptoe.

According to the first aspect, the first projection can be deformed more easily toward the heel than the tiptoe, due to the heel side gap provided between the rear portion of the first projection and the wall of the first through hole closer to the heel. Therefore, for example, when a user wearing the shoes according to the first aspect strongly steps on a floor to make a dash in a forward direction during a game of volleyball, handball, or the like, the first projection in the first through hole of the sole component is smoothly deformed toward the heel at the time of stepping on the floor, and consequently, elastic energy is accumulated in the first projection. When the user makes the dash while shifting his/her weight, the elastic energy accumulated in the first projection is released, resulting in an increase in a force for the dash in the forward direction. On the other hand, this configuration makes the first projection difficult to deform toward the tiptoe. Thus, deformation in the first projection toward the tiptoe in the through hole of the sole component is reduced to a small amount. Therefore, when the user wearing the shoes intends to quickly stop his/her rearward movement, for example, a time lag between the moment at which the user feels himself/herself stopping his/her movement and the timing at which the quick stop is actually made can be eliminated or reduced. This allows the user to make the next movement swiftly.

As can be seen, with the shoe sole structure of the first aspect, the first projection enables the user to shift his/her weight smoothly using the heel of his/her foot as a supporting point, in accordance with the user's movement in the forward-backward direction, while the sole component maintains the cushioning properties and stability for the user's heel.

A second aspect of the present invention is an embodiment of the first aspect. In the second aspect, the rear portion of the first projection constitutes an inclined surface which is inclined downward toward the tiptoe, and the heel side gap is formed between the inclined surface and the wall of the first through hole located closer to the heel.

According to the second aspect, with the simple configuration in which the rear portion of the first projection constitutes the inclined surface, the heel side gap can be provided between the first projection and the wall of the first through hole closer to the heel.

A third aspect of the present invention is an embodiment of the first or second aspect. In the third aspect, the at least one first through hole comprises a plurality of first through holes arranged adjacent to each other at an interval in a longitudinal direction, and the at least one first projection comprises a plurality of first projections each of which is inserted in an associated one of the plurality of the first through holes.

According to the third aspect, the first through holes are arranged adjacent to each other at intervals in the longitudinal direction, and the first projections are each inserted in the associated one of the first through holes. This configuration contributes to a further increase in a grip force, of the entire shoe, acting forward with respect to the floor.

A fourth aspect of the present invention is an embodiment of any one of the first to third aspects. In the fourth aspect, the first projection has a lower end projecting downward to be located below a lower surface of the sole structure.

According to the fourth aspect, each first projection inserted in the associated first through hole has the lower end projecting downward to be located below the lower surface of the sole component. This configuration contributes to a further increase in a grip force of the entire shoe with respect to a floor.

A fifth aspect of the present invention is an embodiment of any one of the first to fourth aspects. In the fifth aspect, the first through hole and the first projection are longer in a width direction than a longitudinal direction.

According to the fifth aspect, each first through hole and each first projection are longer in a width direction than a longitudinal direction. This configuration contributes to a further increase in a grip force, of the entire shoe, acting forward with respect to a floor.

A sixth aspect of the present invention is an embodiment of any one of the first to fifth aspects. In the sixth aspect, the sole component has at least one second through hole in a medial side portion of the sole component, the projection member includes at least one second projection inserted in the at least one second through hole, a medial side gap is formed between a wall of the at least one second through hole located closer to a medial side of the foot and a side portion of the at least one second projection inserted in the at least one second through hole, the side portion facing a medial side of the foot, and due to the medial side gap, the at least one second projection is deformed more easily toward the medial side than a lateral side of the foot.

According to the sixth aspect, when a user strongly steps on a floor to make a dash in a leftward or rightward direction, the second projection in the second through hole of the sole component is smoothly deformed toward the medial side of the foot at the time of the stepping on the floor, and consequently, elastic energy is accumulated in the second projection. When the user makes the dash while shifting his/her weight, the elastic energy accumulated in the second projection is released, resulting in an increase in a force for the dash in the leftward or rightward direction. On the other hand, this configuration makes the second projection difficult to deform toward the lateral side of the foot, and deformation in the second projection toward the lateral side in the second through hole of the sole component is reduced to a small amount. Therefore, when the user wearing the shoes intends to quickly stop his/her movement in the leftward or rightward direction, for example, a time lag between the moment at which the user feels himself/herself stopping his/her movement and the timing at which the quick stop is actually made can be eliminated or reduced. This allows the user to make the next movement swiftly.

A seventh aspect of the present disclosure is an embodiment of the sixth aspect. In the seventh aspect, the second projection has a lower end projecting downward to be located below a lower surface of the sole component.

According to the seventh aspect, each second projection inserted in the associated second through hole has the lower end projecting downward to be located below the lower surface of the sole component. This configuration contributes to a further increase in a grip force of the entire shoe with respect to a floor.

An eighth aspect of the present invention is directed to a shoe including the shoe sole structure according to any one of the first to seventh aspects.

According to the eighth aspect, shoes can be provided which are as advantageous as the first to seventh aspects.

Advantages of the Invention

As described above, according to the present invention, the first projection in the first through hole of the sole component can be deformed easily toward the heel, due to the heel side gap. This contributes to an increase in a force for making a dash in the forward direction. On the other hand, the first projection is difficult to deform toward the tiptoe. Therefore, when a user intends to quickly stop his/her rearward movement, for example, a time lag between the moment at which the user feels himself/herself stopping his/her movement and the timing at which the quick stop is actually made can be eliminated or reduced. This allows the user to make the next movement swiftly. As can be seen, with the shoe sole structure of the present invention, the first projection enables the user to shift his/her weight smoothly using the heel of the user's foot as a supporting point, in accordance with the user's movement in the forward-backward direction, while the sole component maintains the cushioning properties for the user's heel.

DESCRIPTION OF EMBODIMENTS

An embodiment of the present invention will be described in detail with reference to the drawings. Note that the following description of the embodiment is merely an example in nature, and is not intended to limit the scope, application, or uses of the present invention.

FIGS. 1 to 6 show a shoe S according to an embodiment of the present invention. The shoes S are usable for indoor sports such as volleyball, handball, basketball, etc. The drawings illustrate a left shoe S only as an example. Since the right shoe is symmetrical to the left shoe S, only the left shoe S will be described in the following description, and the description of the right shoe will be omitted herein. In the following description, the expressions "above," "upward," "on a/the top of," "below," "under," and "downward," represent the vertical positional relationship between respective components of the shoe S. The expressions "front," "fore," "forward," "anterior," "rear," "hind," "behind," "backward," and "posterior" represent the positional relationship in the longitudinal direction between respective components of the shoe S. The expressions "left (side)," "leftward," "right (side)," and "rightward" represent the positional relationship in the width direction of the shoe S.

Figure 1:
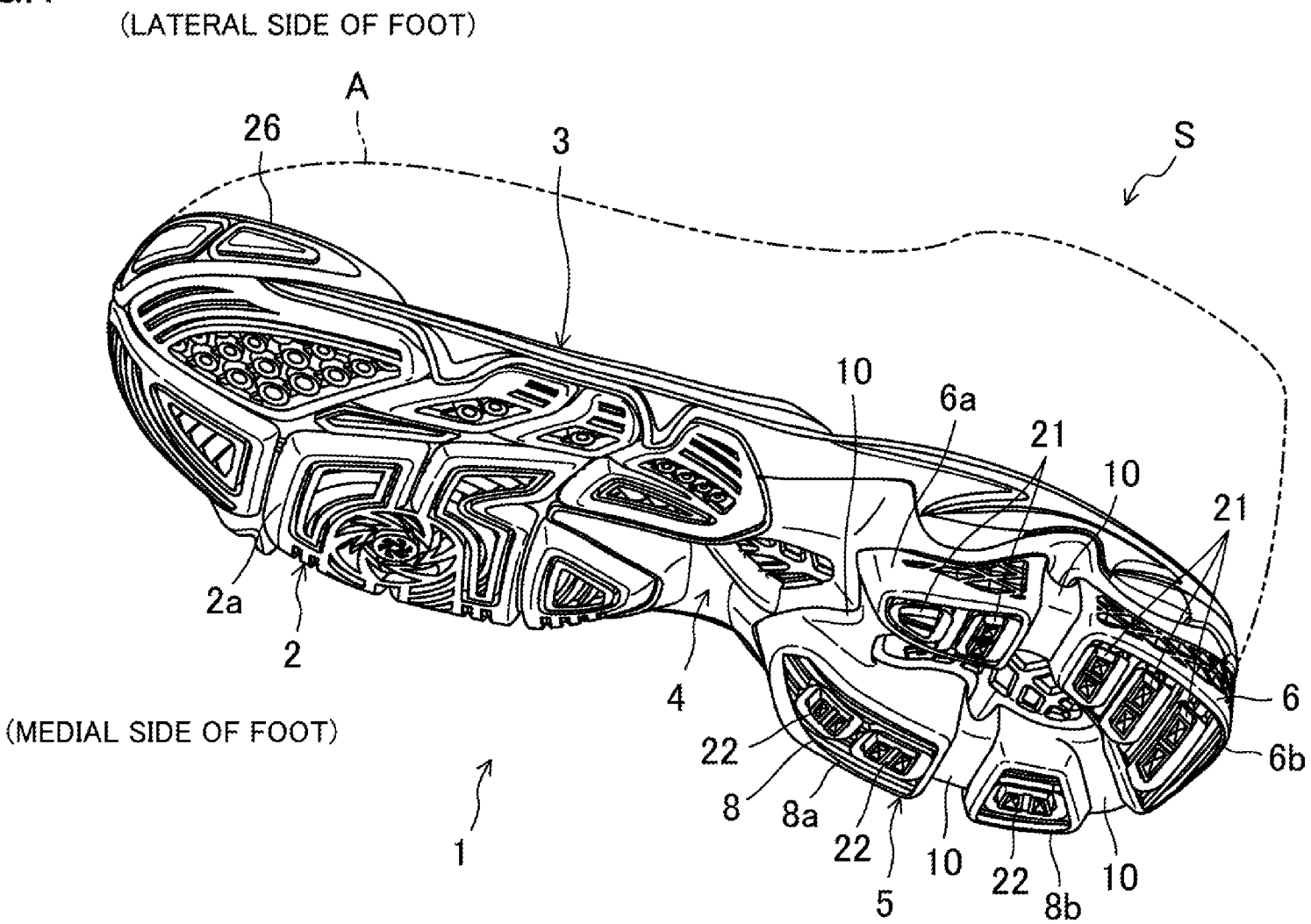
FIG. 1 is a perspective view of a shoe according to an embodiment of the present invention, as viewed from below.
Figure 2:
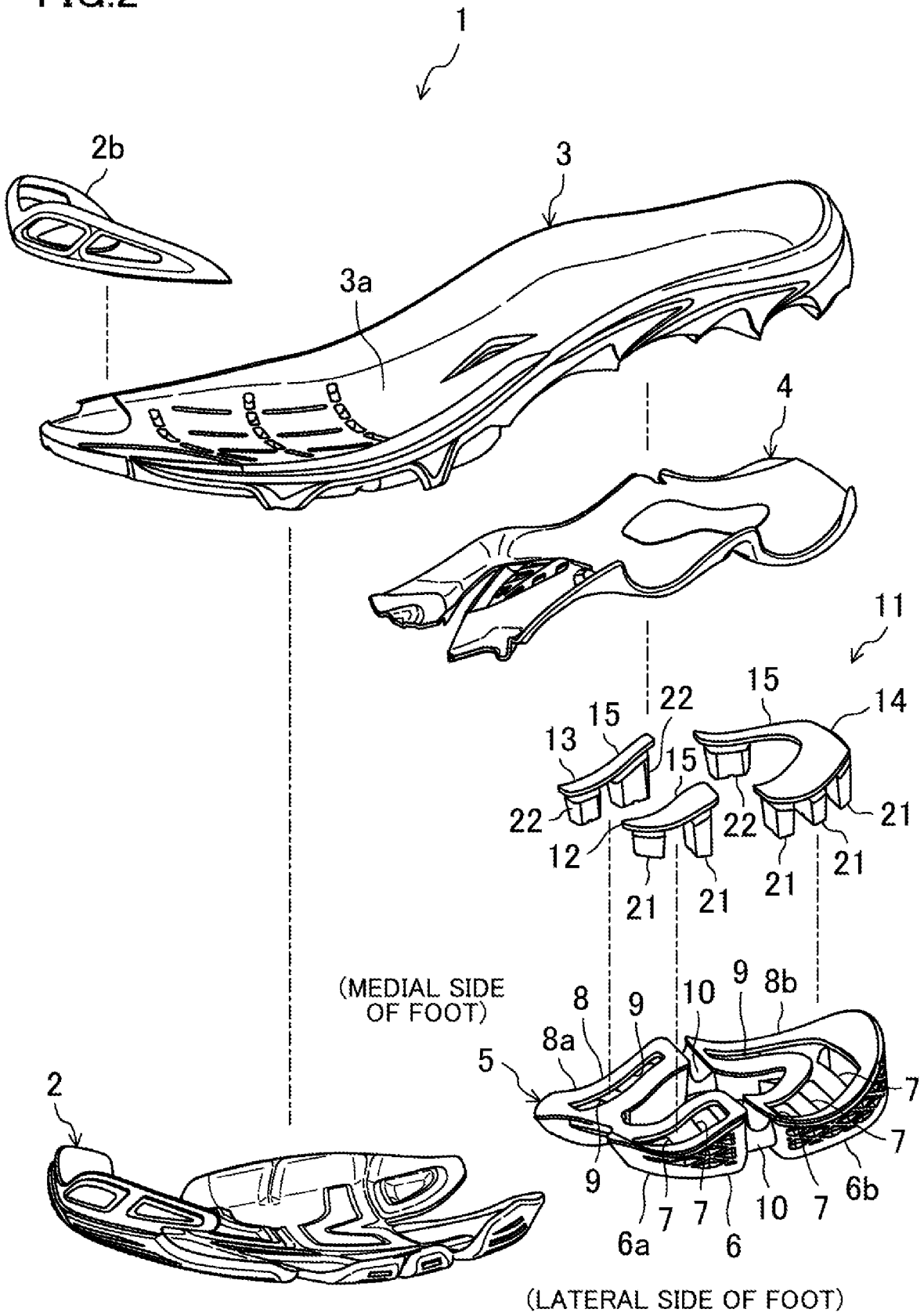
FIG. 2 is an exploded perspective view of a sole structure.
Figure 3:
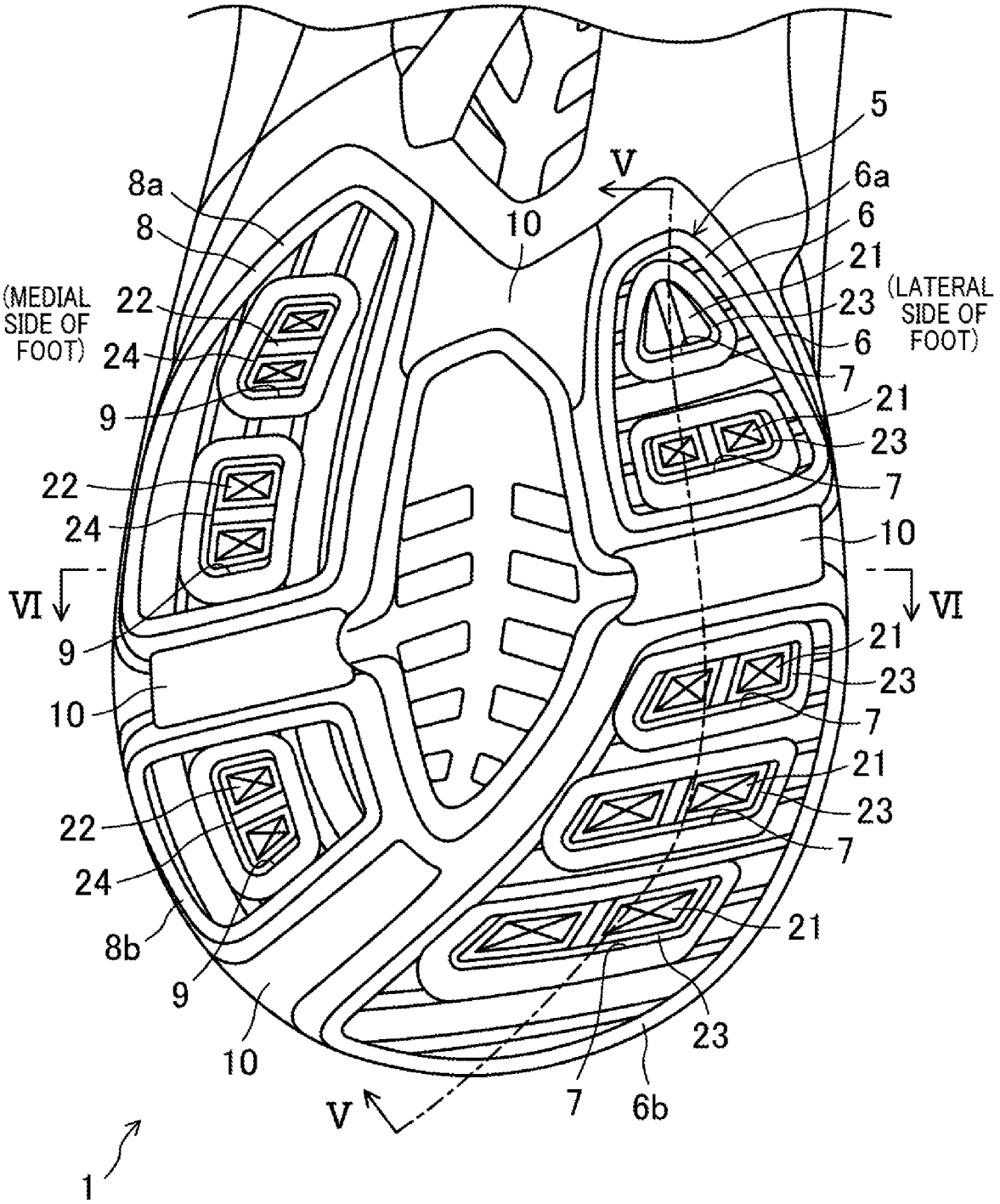
FIG. 3 is a bottom view showing, on an enlarged scale, a heel side portion of the sole structure.

As shown in FIGS. 1 to 3, the shoe S includes a sole structure 1. The sole structure 1 includes, as main elements, an outsole component 2, a midsole component 3, a corrugated plate 4, a sole component 5, and a projection member 11. Each of these components will be described in detail below.

(Outsole Component)

The outsole component 2 extends to correspond to a region, of a human foot, from the plantar arch to the tiptoe, and has, on its lower surface, a ground surface 2*a* configured to contact with a ground surface or floor surface. The outsole component 2 is made from a hard elastic material which is harder than a material for the midsole component 3, which will be described later. Examples of suitable materials for the outsole component 2 include thermoplastic resins such as ethylene-vinyl acetate copolymer (EVA), thermosetting resins such as polyurethane (PU), and rubber materials such as butadiene rubber and chloroprene rubber. The outsole component 2 further includes, at its front end portion, a guard part 2*b* for protecting a tiptoe portion.

(Midsole Component)

The midsole component 3 is configured to support a region, of the plantar surface of a human foot, from the tiptoe to a rear side of the heel. Specifically, the midsole component 3 includes, on its upper portion, a planta support surface 3*a* which is configured to support the plantar surface of a human body, from the tiptoe to the rear side of the heel, and which extends in the longitudinal direction. A lower portion of the midsole component 3 is bonded to an upper portion of the outsole component 2 with an adhesive or the like. A shoe upper A (an instep cover) configured to cover a foot of a user is provided above the midsole component 3. The midsole component 3 is made from a soft elastic material. Suitable examples of the material for the midsole component 3 include thermoplastic synthetic resins such as ethylene-vinyl acetate copolymer (EVA) and foams of the thermoplastic synthetic resins, thermosetting resins such as polyurethane (PU) and foams of the thermosetting resins, and rubber materials such as butadiene rubber and chloroprene rubber and foams of the rubber materials.

(Corrugated Plate)

The corrugated plate 4 extends along a region, of a human foot, from the plantar arch to the rear side of the heel, and is curved to be corrugated in vertical direction as viewed from side. An upper portion of the corrugated plate 4 is bonded to a lower portion of the midsole component 3 with an adhesive or the like. The corrugated plate 4 is preferably made from a hard elastic material. Specific examples of such a hard elastic material include thermoplastic resin such as thermoplastic polyurethane (TPU), polyamide elastomer (PAE), and ABS, and thermosetting resins such as epoxy resins and unsaturated polyester resins. The corrugated plate 4 may also be made from a fiber-reinforced plastic (FRP) containing carbon fibers, aramid fibers, or glass fibers as reinforcement fibers, and a thermosetting resin or a thermoplastic resin as a matrix resin.

The corrugated plate 4 substantially prevents the midsole component 3 from being deformed locally and significantly even if an impact is applied especially in the vertical direction to a heel portion of the planta support surface 3*a* of the midsole component 3. Consequently, when the user is walking or running, the user's ankle is substantially prevented from excessively leaning inward or outward, thereby enabling enhanced stability to be ensured.

(Sole Component)

The sole component 5 is configured to mainly support the heel of a human foot. An upper portion of the sole component 5 is bonded to a lower portion of the corrugated plate 4 with an adhesive or the like. The sole component 5 is made from, for example, a foam of ethylene-vinyl acetate copolymer (EVA) resin, or an EVA rubber material. The sole component 5 enables the heel of the foot to be supported stably, while maintaining the cushioning properties. From the viewpoint of abrasion resistance, the EVA rubber material is more preferable than the foam of EVA resin as the material for the sole component 5.

Figure 4:
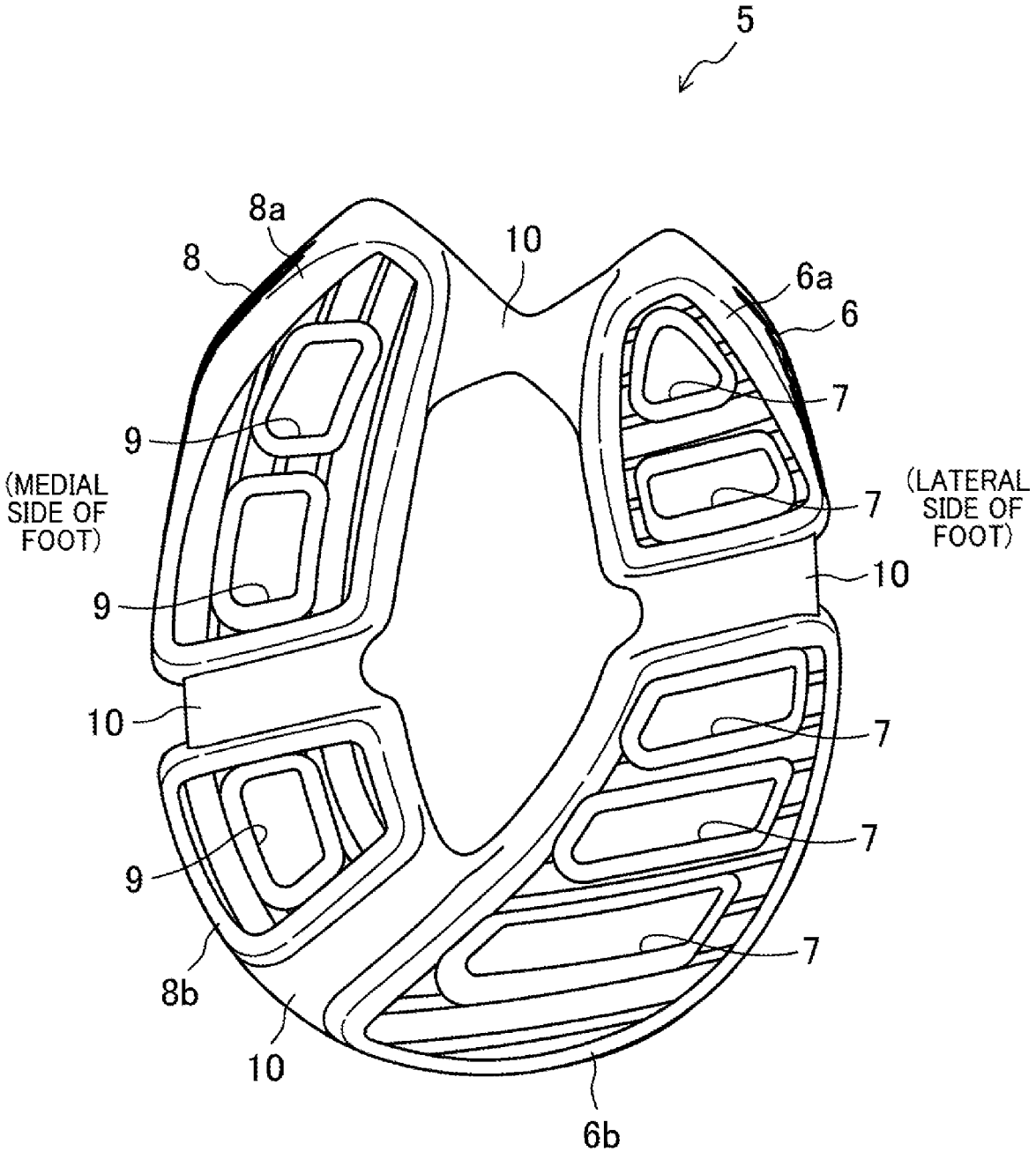
FIG. 4 is a bottom view of the sole structure.

As shown in FIG. 4, the sole component 5 includes a lateral side support 6 configure to support a region of the heel adjacent to a lateral side of the foot, and a medial side support 8 configured to support a region of the heel adjacent to a medial side of the foot. The lateral side support 6 includes a front portion 6*a* and a rear portion 6*b* that are separated from each other in the longitudinal direction. The medial side support 8 includes a front portion 8*a* and a rear portion 8*b* that are separated from each other in the longitudinal direction. The lateral side support 6 extends in the longitudinal direction while a rear end of the front portion 6*a* is coupled to a front end of the rear portion 6*b* via a coupling portion 10. The medial side support 8 extends in the longitudinal direction while a rear end of the front portion 8*a* is coupled to a front end of the rear portion 8*b* via another coupling portion 10. The lateral side support 6 and the medial side support 8 are coupled together via yet another coupling portion 10 and still yet another coupling portion 10 which are arranged in the longitudinal direction.

The lateral side support 6 has a plurality of first through holes 7, 7, . . . which vertically pass through the lateral side support 6 and which are arranged adjacent to each other at predetermined intervals in the longitudinal direction. Specifically, the front portion 6*a* of the lateral side support 6 has two first through holes 7, 7 arranged adjacent to each other at a predetermined interval. One of the first through holes 7, 7 that is located closer to the tiptoe has a substantially triangular shape which is tapered toward the tiptoe, as viewed from bottom. The other first through hole 7 that is located closer to the heel has a substantially rectangular shape which is longer in the width direction than the longitudinal direction, as viewed from bottom. The rear portion 6*b* of the lateral side support 6 has three first through holes 7, 7, . . . arranged adjacent to each other at predetermined intervals. Each first through hole 7 has a substantially rectangular shape which is longer in the width direction than the longitudinal direction, as viewed from bottom.

The medial side support 8 has a plurality of second through holes 9, 9, . . . which vertically pass through the medial side support 8 and which are arranged adjacent to each other at predetermined intervals in the longitudinal direction. Specifically, the front portion 8*a* of the medial side support 8 has two second through holes 9, 9 arranged adjacent to each other at a predetermined interval. Each second through hole 9 has a substantially rectangular shape which is longer in the longitudinal direction than the width direction, as viewed from bottom. The rear portion 8*b* of the medial side support 8 has only one second through hole 9 which is longer in the longitudinal direction than the width direction.

(Projection Member)

As shown in FIG. 2, the projection member 11 is arranged on top of, and combined with, the lateral side support 6 and the medial side support 8 of the sole component 5. The projection member 11 includes a lateral side-front projection member 12 which corresponds to the front portion 6*a* of the lateral side support 6, a medial side-front projection member 13 which corresponds to the front portion 8*a* of the medial side support 8, and a rear projection member 14 which corresponds to the rear portion 6*b* of the lateral side support 6 and the rear portion 8*b* of the medial side support 8. Each of the projection members 12, 13, and 14 is made from, for example, natural rubber (NR), isoprene rubber (IR), isobutylene-isoprene rubber (IIR), styrene-butadiene rubber (SBR), nitrile-butadiene rubber (NBR), or a mixture of at least two of these rubber materials.

Each of the projection members 12, 13, and 14 includes a plate-like base 15 which extends in the longitudinal direction and which is curved upward in the direction from the tiptoe to the heel in cross section. As shown also in FIGS. 5 and 6, an upper portion of each base 15 is fitted and bonded to a respective portion of the lower portion of the corrugated plate 4 with an adhesive or the like.

Figure 5:
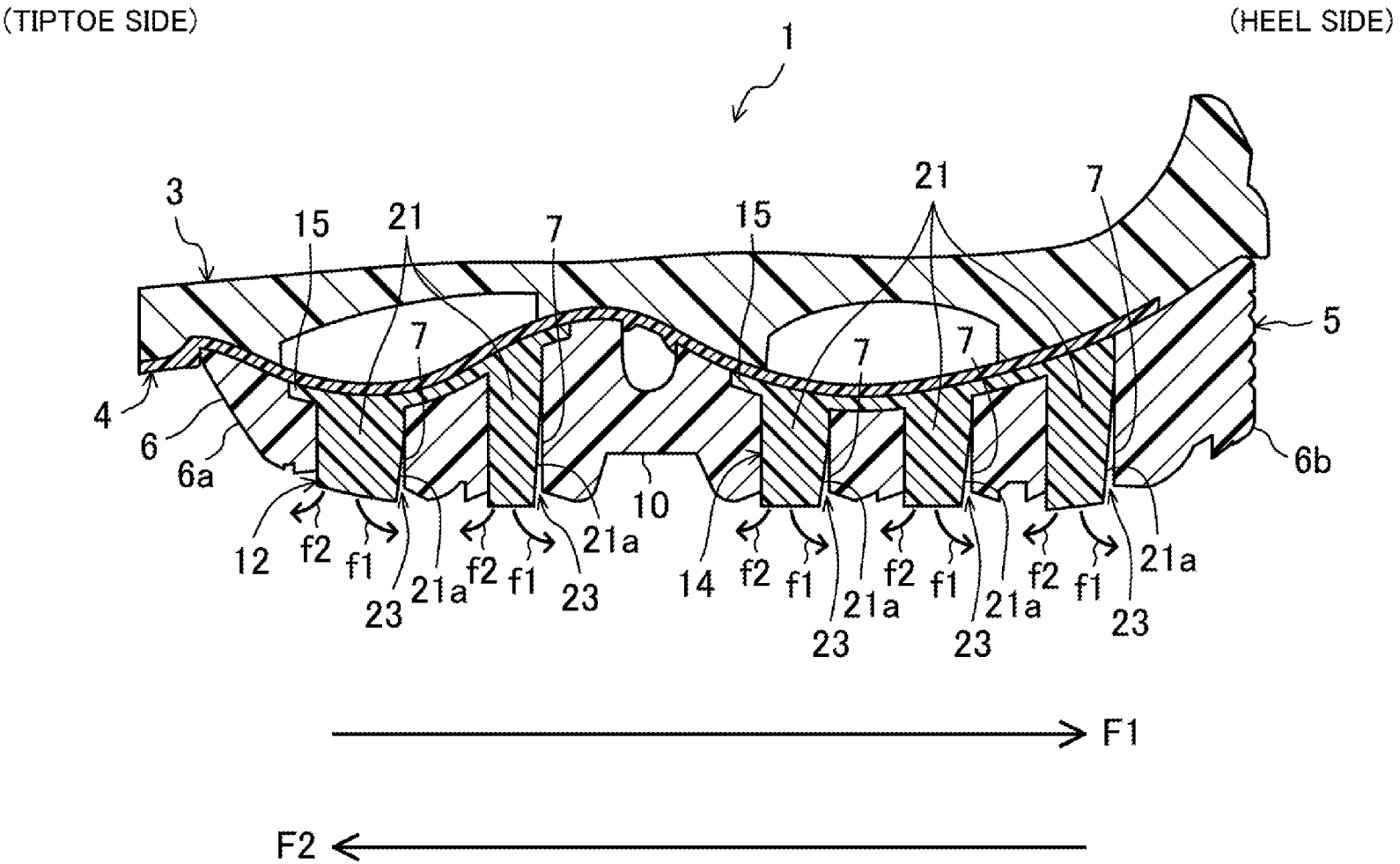
FIG. 5 is a cross-sectional view taken along line V-V in FIG. 3.

As shown in FIG. 5, a plurality of first projections 21, 21 (two projections in the shown example) project downward from the lower surface of the base 15 of the lateral side-front projection member 12. The first projection 21, 21 are arranged adjacent to each other at a predetermined interval in the longitudinal direction. In the lateral side-front projection member 12, one of the first projections 21, 21 that is located closer to the tiptoe has a substantially triangular shape which is tapered toward the tiptoe, as viewed from bottom, whereas the other first projection 21 that is located closer to the heel has a substantially rectangular shape which is longer in the width direction than the longitudinal direction, as viewed from bottom. Further, a plurality of first projections 21, 21, . . . (three projections in the shown example) project downward from a lateral side portion of the lower surface of the base 15 of the rear projection member 14. The first projections 21, 21, . . . are arranged adjacent to each other at predetermined intervals in the longitudinal direction. Each of these first projections 21, 21, . . . has a substantially rectangular shape which is longer in the width direction than the longitudinal direction, as viewed from bottom. The first projections 21 are formed such that in a state where each projection 21 is inserted in an associated one of the first through holes 7, the lower end of each first projection 21 projects downward from the associated through hole 7 to be located below the lower surface of the sole component 5.

Each first projection 21 extends in the vertical direction such that its front portion is substantially vertical in cross section. In a state where each first projection 21 is inserted in the associated first through hole 7, the front portion is in contact with a wall, of the first through hole 7, located closer to the tiptoe, substantially without a gap.

Further, a rear portion of each first projection 21 constitutes an inclined surface 21*a* which is inclined toward the lower end of the first projection 21 in the direction from the heel to the tiptoe. In the state where each projection 21 is inserted in the associated first through hole 7, a heel side gap 23 is formed between the inclined surface 21*a* and a wall, of the associated through hole 7, located closer to the heel. In the state where each first projection 21 is inserted in the associated first through hole 7, due to the heel side gap 23, the first projection 21 can be deformed more easily toward the heel than the tiptoe.

As shown in FIG. 2, a plurality of second projections 22, 22 (two projections in the shown example) project downward from the lower surface of the base 15 of the medial side-front projection member 13. On the other hand, another second projection 22 is provided on a medial side portion of the lower surface of the base 15 of the rear projection member 14. Each second projection 22 has a substantially rectangular shape which is longer in the longitudinal direction than the width direction, as viewed from bottom. The second projections 22 are arranged adjacent to each other at predetermined intervals in the longitudinal direction. The second projections 22 are formed such that in a state where each second projection 22 is inserted in an associated one of the second through holes 9, the lower end of each second projection 22 projects downward from the associated second through hole 9 to be located below the lower surface of the sole component 5.

Figure 6:
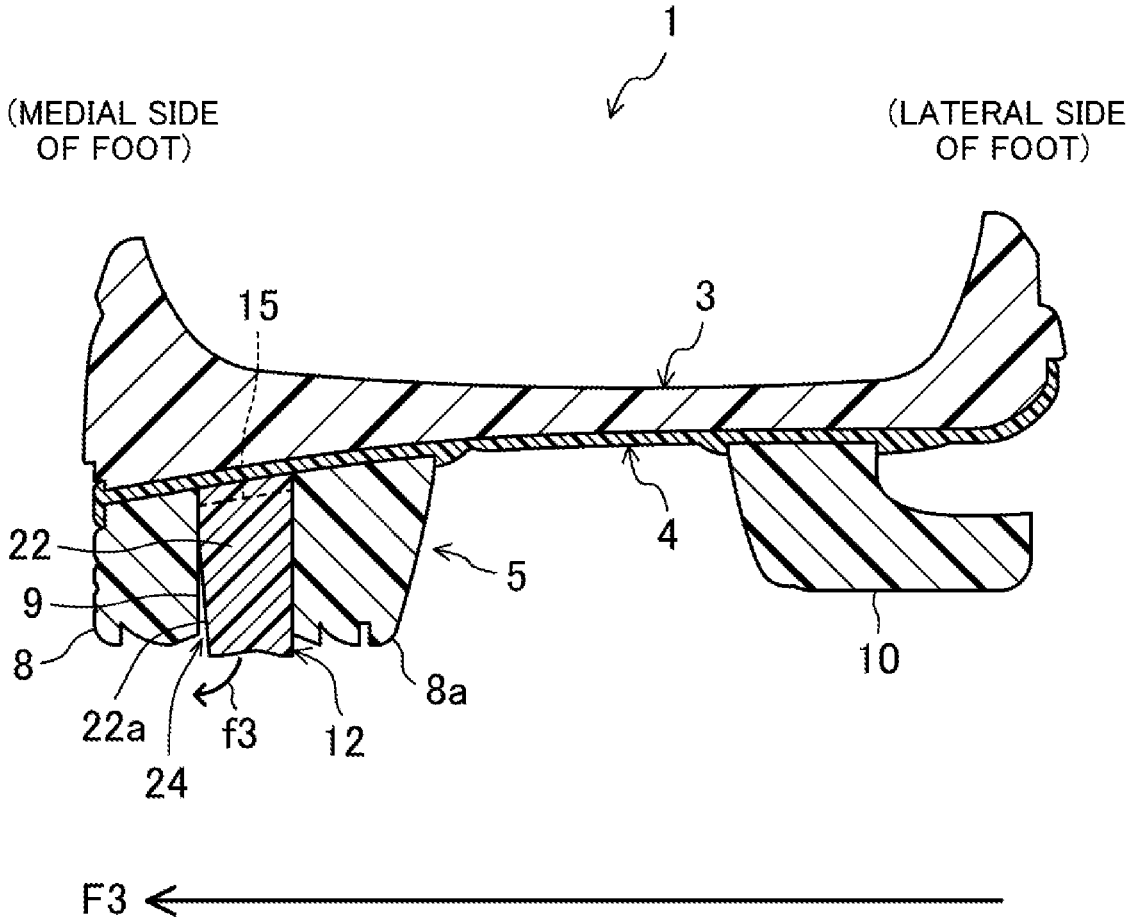
FIG. 6 is a cross-sectional view taken along line VI-VI in FIG. 3.

As shown in FIG. 6, each second projection 22 extends in the vertical direction such that a side portion facing the lateral side of the foot is substantially vertical in cross section. In a state where each second projection 22 is inserted in the associated second through hole 9, the side portion is in contact with a wall, of the first through hole 9, located closer to the lateral side of the foot, substantially without a gap.

Further, another side portion of each second projection 22 facing the medial side of the foot constitutes an inclined surface 22*a* which is inclined toward the lower end of the second projection 22 in the direction from the medial side to the lateral side of the foot. In the state where each second projection 22 is inserted in the associated second through hole 9, a medial side gap 24 is formed between the inclined surface 22*a* and a wall, of the associated second through hole 9, located closer to the medial side of the foot. In the state where each second projection 22 is inserted in the associated second through hole 9, due to the medial side gap 24, the second projection 22 can be deformed more easily toward the medial side than the lateral side of the foot.

(Effects of Embodiment)

For example, when a user wearing the shoes S according to the embodiment of the present invention strongly steps on a floor to make a dash in the forward direction during a game of volleyball, handball, or the like, a reaction force F1 caused by the stepping on the floor is applied to each first projection 21. Consequently, each first projection 21 in the associated one of the first through holes 7 of the sole component 5 is deformed smoothly toward the heel (see arrows f1 in FIG. 5). Each first projection 21 accumulates elastic energy based on the deformation in the first projection 21. When the user shifts his/her weight to make the dash, the elastic energy is released to generate a grip force acting forward. As a result, the force for the dash in the forward direction can be increased.

Contrary to the above case, for example, when a user wearing the shoes S intends to quickly stop his/her rearward movement, a reaction force F2 from the floor is applied to each first projection 21, as shown in FIG. 5. In this case, since each first projection 21 is difficult to deform toward the tiptoe in the associated first through hole 7, deformation in each first projection 21 toward the tiptoe in the associated one of the through holes 7 of the sole component 5 is reduced to a small amount (see arrows f2 in FIG. 5). Specifically, when the user wearing the shoes S intends to quickly stop his/her rearward movement, almost no deformation occurs in each first projection 21 in the associated through hole 7, substantially preventing a strong grip force to be generated. This can eliminate or reduce a time lag between the moment at which the user feels himself/herself stopping his/her movement and the timing at which the quick stop is actually made. As a result, the user can make the next movement swiftly.

As can be seen, the first projections 21 enable the user to shift his/her weight smoothly from the heel of his/her foot in accordance with the user's movement in the forward-backward direction, while the sole component 5 maintains the cushioning properties and stability for the user's heel.

On the other hand, when the user, who is performing, for example, repeated side stepping, strongly steps on the floor with the heel of his/her left foot (in particular, with a medial side portion of the heel) to quickly stop his/her leftward movement and swiftly make the next rightward movement (i.e., toward the medial side of the left foot shown in FIG. 6), a reaction force F3 is applied to each second projection 22, as shown in FIG. 6. Consequently, each second projection 22 is deformed in the associated one of the second through holes 9 of the sole component 5 toward the medial side of the foot (see the arrow f3 in FIG. 6). Each second projection 22 is smoothly deformed toward the medial side of the foot in the associated second through hole 9 of the sole component 5 at the time of the stepping on the floor, resulting in that elastic energy is accumulated in the second projection 22. When the user shifts his/her weight to make a dash, the elastic energy accumulated in each second projection 22 is released to generate a grip force, increasing a force for the dash in the leftward or rightward direction.

In this embodiment, the rear portion of the first projection 21 constitutes the inclined surface 21*a*. With this simple configuration, the heel side gap 23 can be provided between the first projection 21 and the wall of the first through hole 7 closer to the heel.

Further, in this embodiment, the first through holes 7, 7, . . . are arranged adjacent to each other at intervals in the longitudinal direction, and the first projections 21, 21, . . . are each inserted in the associated one of the first through holes 7, 7, . . . . This configuration contributes to a further increase in a grip force, of the entire shoe, acting forward with respect to a floor.

Further, in this embodiment, each first projection 21 inserted in the associated first through hole 7 has its lower end projecting downward from the first through hole 7 to be located below the lower surface of the sole component 5, and each second projection 22 inserted in the associated second through hole 9 has its lower end projecting downward from the second through hole 9 to be located below the lower surface of the sole component 5. This configuration allows the forces F1 and F3 to act directly on the first and second projections 21 and 22, respectively. As a result, the entire shoe can have a further increased grip force acting forward and a further increased grip force acting in the width direction with respect to a floor.

Further, in this embodiment, the first through holes 7 and the first projections 21 are each longer in the width direction than the longitudinal direction. This configuration increases each area configured to receive the action of the force F1. As a result, the entire shoe can have a further increased grip force acting forward with respect of a floor.

Other Embodiments

The sole structure 1 of the embodiment described above includes the outsole component 2, the midsole component 3, and the corrugated plate 4. However, this is merely a non-limiting example. For example, the sole component 5 may have a planta support surface configured to support the plantar surface, of a human foot, extending from the tiptoe to a rear side of the heel, and may include the lateral side support 6 and the medial side support 8 in a heel portion of the sole component 5. The projection member 11 may be combined with the lateral side support 6 and the medial side support 8 of the sole component 5, thereby forming the sole structure 1. The sole structure 1 having this configuration does not need the outsole component 2, midsole component 3, or the corrugated plate 4.

The sole structure 1 of the embodiment described above includes the plurality of first through holes 7, 7, . . . , the plurality of second through holes 9, 9, . . . , the plurality of first projections 21, 21, . . . , and the plurality of second projections 22, 22, . . . . However, this is merely a non-limiting example. The sole structure 1 may include one first through hole 7, one second through hole 9, one first projection 21, and one second projection 22.

Note that the present invention is not limited to the embodiment described above, and various changes and modifications may be made without departing from the scope of the present invention.

INDUSTRIAL APPLICABILITY

The present invention is industrially applicable, for example, as sports shoes for indoor sports such as volleyball, handball, and basketball.

DESCRIPTION OF REFERENCE CHARACTERS

S Shoe
1 Sole Structure
2 Outsole Component
3 Midsole Component
4 Corrugated Plate
5 Sole Component
6 Lateral Side Support
7 First Through Hole
8 Medial Side Support
9 Second Through Hole
11 Projection Member
12 Lateral-Side Front Projection Member
13 Medial-Side Front Projection Member
14 Rear Projection Member
15 Base
21 First Projection
21*a* Inclined Surface
23 HeelSide Gap
22 Second Projection
22*a* Inclined Surface
24 Medial Side Gap

The invention claimed is:

1. A shoe sole structure comprising:

a sole component configured to support a heel of a human foot, and having at least one first through hole vertically passing through a lateral side portion of the sole component; and a projection member provided above the sole component, and including a base, and at least one first projection projecting from a lower surface of the base and inserted in the at least one first through hole of the sole component, wherein a gap on a side of a heel of the sole component is formed between a wall of the at least one first through hole configured to be located closer to the heel of the sole component and a rear portion of the at least one first projection inserted in the at least one first through hole, due to the gap on the side of the heel of the sole component, the at least one first projection is more easily deformable toward the heel of the sole component than toward a tiptoe of the sole component, the at least one first through hole comprises a plurality of first through holes arranged adjacent to each other at an interval in a longitudinal direction, and the at least one first projection comprises a plurality of first projections each of which is inserted in an associated one of the plurality of the first through holes.

2. The shoe sole structure of claim 1, wherein the rear portion of the at least one first projection constitutes an inclined surface which is inclined downward and configured to be toward the tiptoe of the sole component, and the gap on the side of the heel of the sole component is formed between the inclined surface and the wall of the at least one first through hole located closer to the heel of the sole component.

3. A shoe comprising the shoe sole structure of claim 2.

4. The shoe sole structure of claim 1, wherein the at least one first projection has a lower end projecting downward to be located below a lower surface of the component.

5. A shoe comprising the shoe sole structure of claim 4.

6. The shoe sole structure of claim 1, wherein the at least one first through hole and the at least one first projection are longer in a width direction than a longitudinal direction.

7. A shoe comprising the shoe sole structure of claim 6.

8. The shoe sole structure of claim 1, wherein the sole component has at least one second through hole in a medial side portion of the sole component, the projection member includes at least one second projection inserted in the at least one second through hole, a medial side gap is formed between a wall of the at least one second through hole configured to be located closer to a medial side of the foot and a side portion of the at least one second projection inserted in the at least one second through hole, the side portion configured to face the medial side of the foot, and due to the medial side gap, the at least one second projection is more easily deformable toward the medial side of the foot than toward a lateral side of the foot, when worn.

9. The shoe sole structure of claim 8, wherein the at least one second projection has a lower end projecting downward to be located below a lower surface of the sole component.

10. A shoe comprising the shoe sole structure of claim 9.

11. A shoe comprising the shoe sole structure of claim 8.

12. A shoe comprising the shoe sole structure of claim 1.

* * * * *